US010213643B2

(12) United States Patent
Zeng

(10) Patent No.: US 10,213,643 B2
(45) Date of Patent: Feb. 26, 2019

(54) ADJUSTMENT BRACKET STRUCTURE FOR FRONT UPRIGHT OF EXERCISE BICYCLE

(71) Applicants: XIAMEN DMASTER HEALTH TECH CO., LTD., Xiamen (CN); JunMing Zeng, Xiamen (CN)

(72) Inventor: JunMing Zeng, Xiamen (CN)

(73) Assignees: XIAMEN DMASTER HEALTH TECH CO., LTD., Xiamen (CN); Junming Zeng, Xiamen (CN)

( * ) Notice: Subject to any disclaimer, the term of this patent is extended or adjusted under 35 U.S.C. 154(b) by 0 days.

(21) Appl. No.: 15/547,306

(22) PCT Filed: Aug. 31, 2015

(86) PCT No.: PCT/CN2015/088597
§ 371 (c)(1),
(2) Date: Jul. 28, 2017

(87) PCT Pub. No.: WO2016/101648
PCT Pub. Date: Jun. 30, 2016

(65) Prior Publication Data

US 2018/0104535 A1 Apr. 19, 2018

(30) Foreign Application Priority Data

Dec. 26, 2014 (CN) ..... 2014 2 0840155 U

(51) Int. Cl.
*A63B 22/00* (2006.01)
*A63B 22/06* (2006.01)
*A63B 21/00* (2006.01)

(52) U.S. Cl.
CPC ..... *A63B 22/0605* (2013.01); *A63B 22/0046* (2013.01); *A63B 21/4035* (2015.10); *A63B 22/0664* (2013.01); *A63B 2225/093* (2013.01)

(58) Field of Classification Search
None
See application file for complete search history.

(56) References Cited

U.S. PATENT DOCUMENTS 5,616,111 A * 4/1997 Randolph ..... A63B 21/00072 482/123
6,019,710 A * 2/2000 Dalebout ..... A63B 22/0664 482/51

(Continued)

FOREIGN PATENT DOCUMENTS

CN 201223677 Y 4/2009
CN 201799060 U 4/2011

(Continued)

*Primary Examiner* — Stephen R Crow
(74) *Attorney, Agent, or Firm* — Muncy, Geissler, Olds & Lowe, P.C.

(57) ABSTRACT

An adjustment bracket structure for a front upright of an exercise bicycle comprises a bicycle frame and the front upright, wherein a supporting component extending towards the front upright is fixed to the bicycle frame, and the lower end of the front upright is pivoted to the supporting component through a rotary shaft; a bracket component capable of being clamped on the supporting component is arranged on the front upright, and bracket parts matched with the bracket component are arranged on the supporting component in the swinging direction of the front upright. The front upright is angle-adjustable, thereby convenient for users with different heights and arm lengths. The bracket component is of strength-saving structure and utilizes the lever principle, thereby being more convenient to operate. All components are structurally reliable and connected firmly and stably, and thus more convenient to use on the premise of guaranteeing safety and stability.

10 Claims, 11 Drawing Sheets

(56) References Cited

U.S. PATENT DOCUMENTS

| | | | | |
|---|---|---|---|---|
| 7,703,845 | B2 | 4/2010 | Smith et al. | |
| 9,937,380 | B2 * | 4/2018 | Giannelli | A63B 22/0017 |
| 2003/0060336 | A1 * | 3/2003 | Ryan | A63B 22/0605 482/51 |
| 2007/0054782 | A1 | 3/2007 | Lin | |
| 2008/0200313 | A1 * | 8/2008 | Volk | A63B 5/10 482/30 |
| 2008/0238160 | A1 * | 10/2008 | Huyck | A63B 22/0605 297/195.11 |
| 2008/0238161 | A1 * | 10/2008 | Huyck | A63B 22/0605 297/215.13 |
| 2015/0246260 | A1 * | 9/2015 | Giannelli | A63B 22/0017 482/8 |
| 2018/0104535 | A1 * | 4/2018 | Zeng | A63B 22/0605 |

FOREIGN PATENT DOCUMENTS

| | | | |
|---|---|---|---|
| CN | 103043145 | A | 4/2013 |
| CN | 204337639 | U | 5/2015 |
| TW | M442855 | U1 | 12/2012 |

* cited by examiner

ADJUSTMENT BRACKET STRUCTURE FOR FRONT UPRIGHT OF EXERCISE BICYCLE

BACKGROUND OF THE INVENTION

Technical Field

The utility model belongs to improvement techniques for exercise bicycles, and particularly relates to the improvement of installation and adjustment structures for front uprights of exercise bicycles.

Description of Related Art

Front uprights are arranged on the front portions of most existing exercise bicycles (such as stationary bikes) and fixedly connected with bicycle frames, the angles of the front uprights are fixed and cannot be adjusted, and thus the comfort requirement of body builders with different heights and aim lengths cannot be met easily.

BRIEF SUMMARY OF THE INVENTION

For this reason, the utility model aims to provide an adjustment bracket structure for a front upright of an exercise bicycle, and through the adjustment bracket structure, the angle of the front upright can be adjusted conveniently, and the structure is stable.

According to the scheme adopted by the utility model for solving the above technical problems:

An adjustment bracket structure for a front upright of an exercise bicycle comprises a bicycle frame and the front upright, wherein a supporting component which extends towards the front upright is fixed to the bicycle frame, the lower end of the front upright is pivoted to the supporting component through a rotary shaft, a bracket component capable of being clamped on the supporting component is arranged on the front upright, and a plurality of bracket parts matched with the bracket component are arranged on the supporting component in the swinging direction of the front upright.

Wherein, according to one structure design of the bracket parts, the bracket parts are a plurality of positioning tooth grooves formed in the supporting component in the swinging direction of the front upright. In addition, the bracket component is a U-shaped component, two side pieces of the U-shaped component are positioned on the two sides of the front upright through rotating points respectively, the lower ends of the two side pieces or the lower end of one side piece are/is clamped in the positioning tooth grooves, and a handle is located and arranged on the outer side of a middle piece of the U-shaped component.

Wherein, according to another structure design of the bracket parts, the bracket parts are a plurality of positioning holes formed in the supporting component in the swinging direction of the front upright, and positioning pins inserted into the positioning holes in the bracket parts are arranged on the bracket component. In addition, the bracket component is a U-shaped component, two side pieces of the U-shaped component are positioned on the two sides of the front upright through rotating points respectively, positioning pins are located on a middle piece of the U-shaped component, and a handle is arranged on the outer side of the middle piece of the U-shaped component.

According to further optimization of the above scheme, gaps a are formed between the two side pieces and the side wall of the front upright, and the dimension of the gaps a is slightly greater than the material thickness of the supporting component.

According to further optimization of the above scheme, the number of the bracket components is two, the two bracket components are arranged on the left side and the right side of the front upright respectively and connected to the front upright through the same central rotating point or through different rotating points, and the bracket parts corresponding to the bracket components are arranged on the left side and the right side of the upper end of a U-shaped material.

According to further optimization of the above scheme, the distances from the rotating points to the positioning tooth grooves are smaller than the distances from the rotating points to the handle.

In addition, the supporting component is a material with a U-shaped cross-section, and the lower section of the front upright is sleeved with the U-shaped material.

The front upright of the utility model is of an angle-adjustable form, thereby being used by body builders with different heights and arm lengths conveniently. The bracket component is of strength-saving structures and sufficiently utilizes the lever principle, thereby being more convenient to operate. All components are reliable in structural design and connected firmly and stably, and thus the structure is more convenient to use on the premise of guaranteeing safety and stability.

DETAILED DESCRIPTION OF THE INVENTION

For a better understanding of the technical scheme of the utility model by those skilled in the field, a further description of the utility model is given with accompanying drawings as follows.

As shown in FIGS. 1-7, an adjustment bracket structure for a front upright of an exercise bicycle disclosed by the embodiment is applied to the exercise bicycle, and the exercise bicycle, such as a stationary bicycle, is provided with a bicycle frame 1 and the front upright 2, and the front upright 2 is located in front of the bicycle frame 1 and used for mounting a handrail or a display screen.

Figure 10:
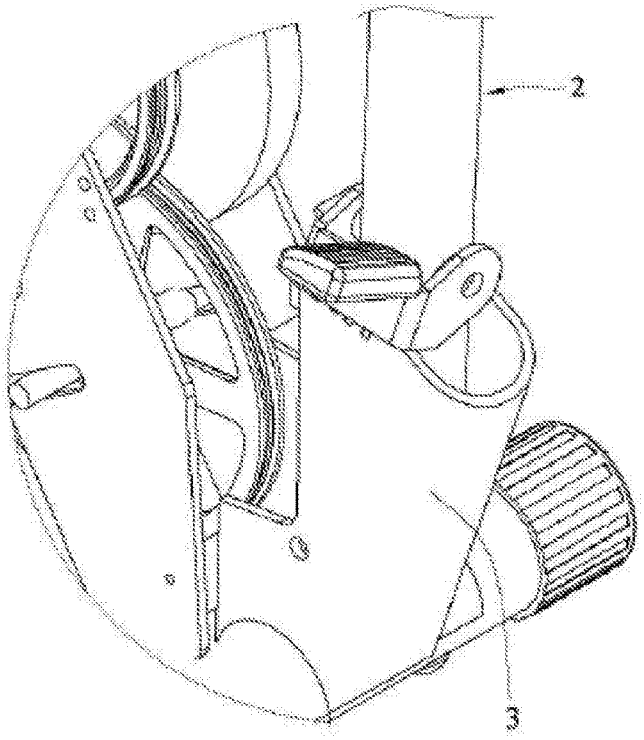
FIGS. 10-11 are structure schematic diagrams of a U-shaped material in a semi-ellipse shape.
Figure 11:
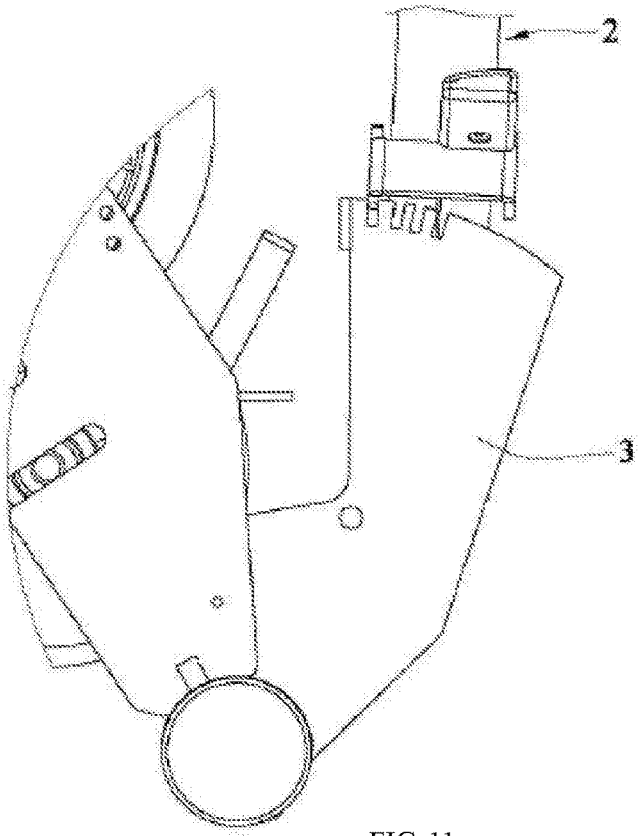

Specifically, a supporting component 3 which extends (upwards) towards the front upright 2 is fixed to the bicycle frame 2, the supporting component 3 is a material with a U-shaped cross-section, the lower section of the front upright 2 is sleeved with the U-shaped material (specifically, the U-shaped material can be structurally semicircular or semi-elliptic as shown in FIGS. 10-11), and the width of an inner cavity of the U-shaped material is consistent with the width of the front upright 2 so that the front upright 2 can be wrapped with the U-shaped material, ensuring that the front upright 2 can swing inside relative to the U-shaped material, and also ensuring that the front upfront 2 does not shake. The lower end of the front upright 2 is pivoted to the supporting component 3 through a rotary shaft 4, and the front upright 2 can swing by certain angles relative to the supporting component 3. For positioning the front upright 2 at multiple angles, a plurality of bracket parts 31 (in the embodiment, the bracket parts 31 are positioning tooth grooves A, B, C, D and E shown in FIG. 4) are arranged at the upper end of the supporting component 3 in the swinging direction of the front upright 2 (the front-back direction of a body builder), and a bracket component 5 which can be clamped in the positioning tooth grooves 31 is arranged on the front upright 2.

In the embodiment, the bracket component 5 is the U-shaped component (specifically, the U-shaped bracket component 5 can be structurally semicircular or semi-elliptic), and two side pieces 52 of the U-shaped component are rotatably connected to the two sides of the front upright 2 through rotating points 21 respectively; and the front upright 2 is wrapped with the two side pieces 52, so that looseness is avoided when the bracket component 5 is rotated frequently, and the structure is firm. Gaps a are formed between the two side pieces 52 and the side wall of the front upright 2, the dimension of the gaps a is slightly greater than the material thickness of the supporting component, and thus the bracket component 5 can be smoothly clamped into the positioning tooth grooves 31. The lower end of one side piece 52 of the bracket component 5 extends downwards to be clamped in one positioning tooth groove 31 (of course, both side pieces of the bracket component 5 can be clamped in the positioning tooth grooves, and only the number of the positioning tooth grooves and the distance between the positioning tooth grooves need to be increased correspondingly to meet the requirement that the distance between the two side pieces is an integral multiple of the distance between the positioning tooth grooves), a handle 51 is arranged at the outer end of the middle piece 53 of the U-shaped component, and the side pieces 52 can be disengaged from and clamped into the positioning tooth grooves 31 by pushing the handle 51 up and down. For pushing the handle 51 to swing up and down effortlessly, the distances from the rotating points 21 to the positioning tooth grooves 31 are smaller than the distances from the rotating points 21 to the handle 51 (namely, as a triangle formed by connecting three points 01, 02 and 03 in FIG. 5, and this is approximate to the cam principle). When the bracket component 5 swings up and down, great force can be generated for pressing the lower ends of the side pieces 52 into the positioning tooth grooves 31 by only applying small force to the handle 51, then the bracket component 5 can be tightly matched with the positioning grooves 31, structure instability caused by the gaps is eliminated, the bracket component 5 is not prone to being disengaged from the positioning tooth grooves 31 easily, and a certain self-locking effect is achieved.

When the angle of the front upright 2 relative to the supporting component 3 needs to be adjusted, the handle 51 is pushed upwards firstly to disengage the lower ends of the side pieces 52 from the positioning tooth grooves 31, the front upright 2 is in a free state and can swing. Then the front upright 2 is pushed front and back to the proper angle, finally the handle 51 is pushed downwards to clamp the lower ends of the side pieces 52 in the positioning tooth grooves 31 again, and thus the front-back direction of the front upright 2 is fixed.

Through the structure designed in the above embodiment, convenience of use can be guaranteed, and connection stability and reliability of all components can be guaranteed, for example the front upright 2 and the supporting component 3 are connected reliably, and the bracket component 5 is positioned in the positioning tooth grooves 31 stably and reliably.

Figure 1:
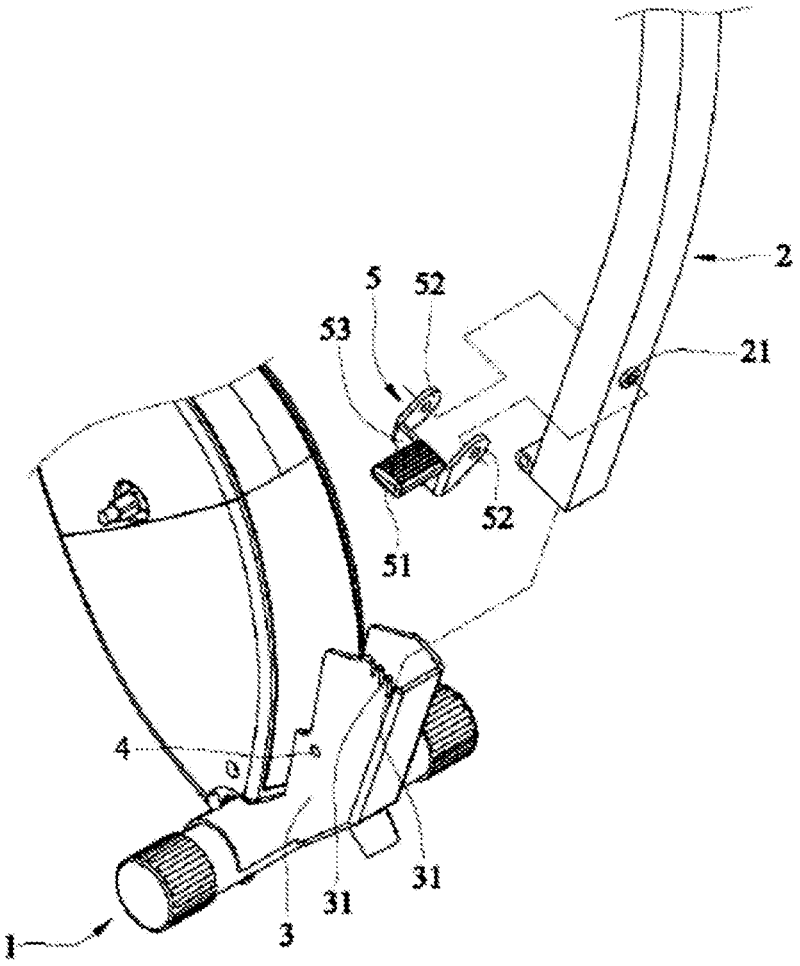
FIG. 1 is a structure schematic diagram of an embodiment applied to an exercise bicycle.
Figure 2:
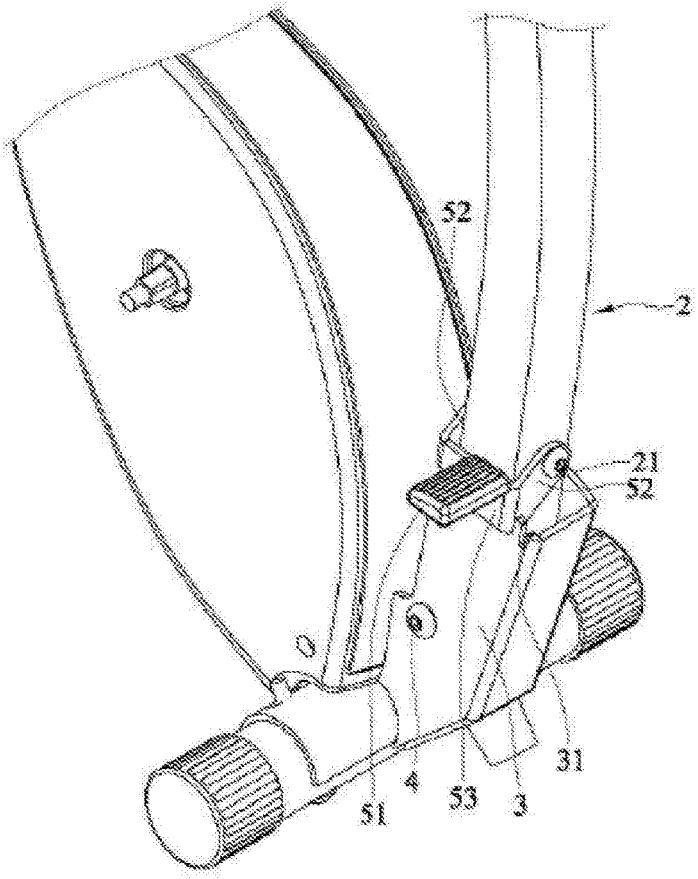
FIG. 2 is an overall structure schematic diagram of the embodiment of the utility model.
Figure 3:
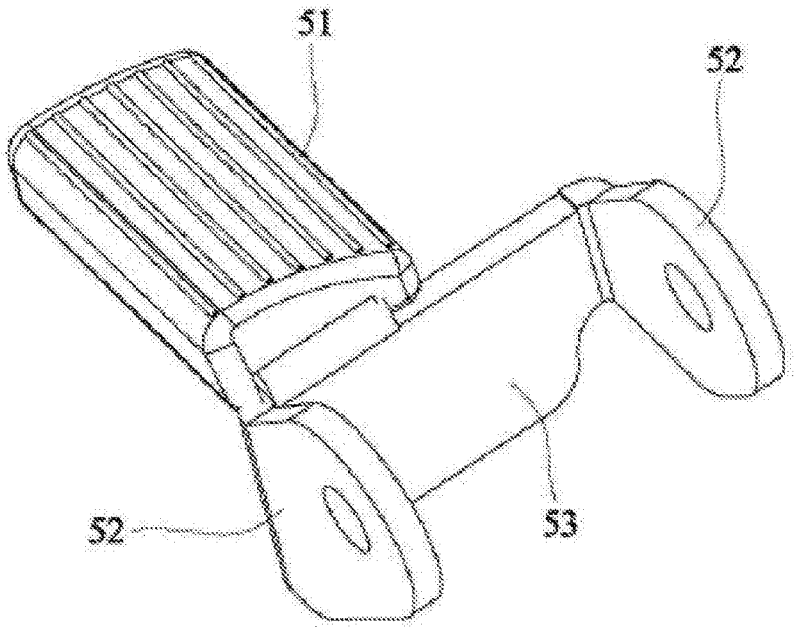
FIG. 3 is a structure schematic diagram of a bracket component of the embodiment.
Figure 4:
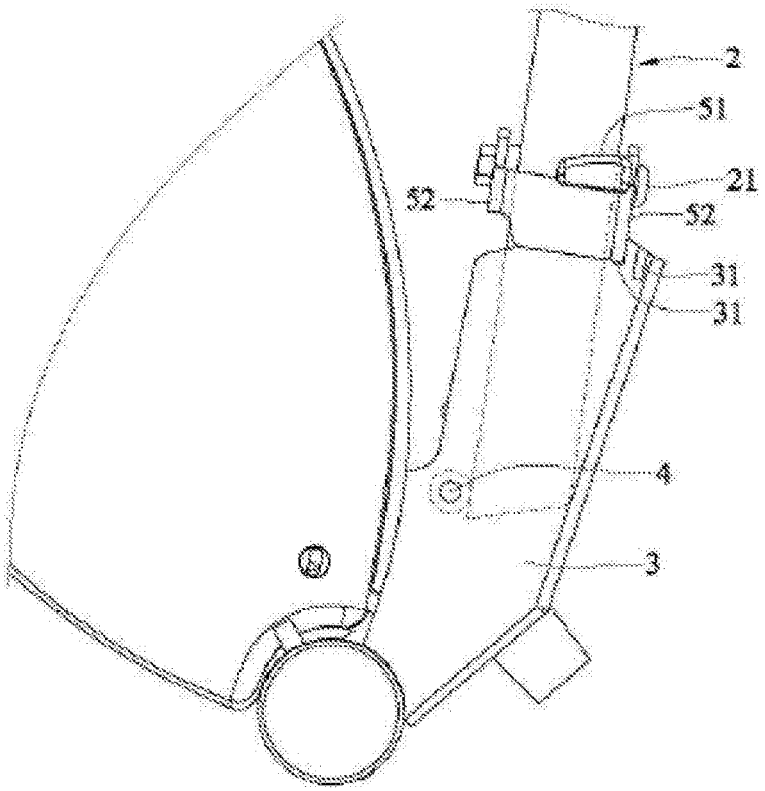
FIG. 4 is a structure schematic diagram of the bracket component in the locked state of the embodiment.
Figure 5:
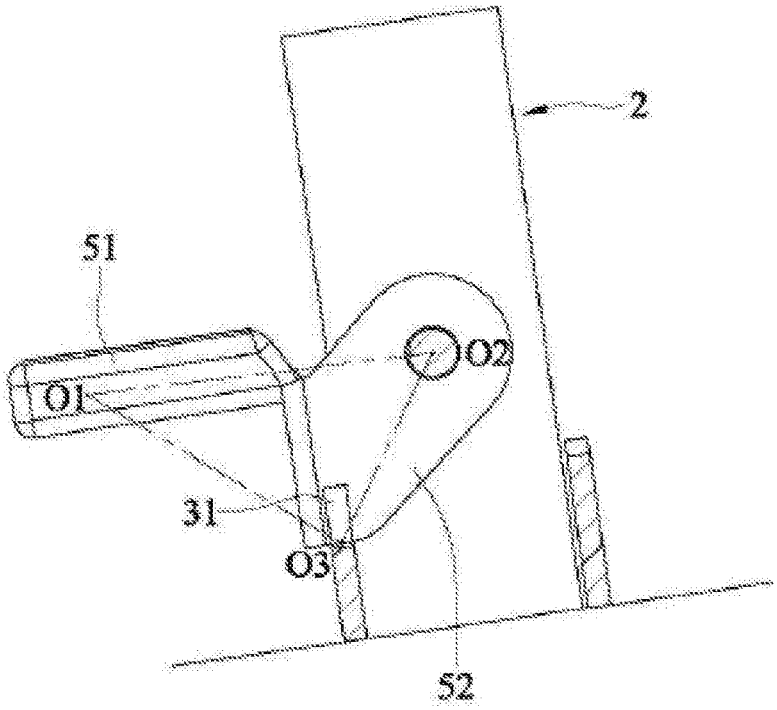
FIG. 5 is a side-view structure schematic diagram of the bracket component in the locked state of the embodiment.
Figure 6:
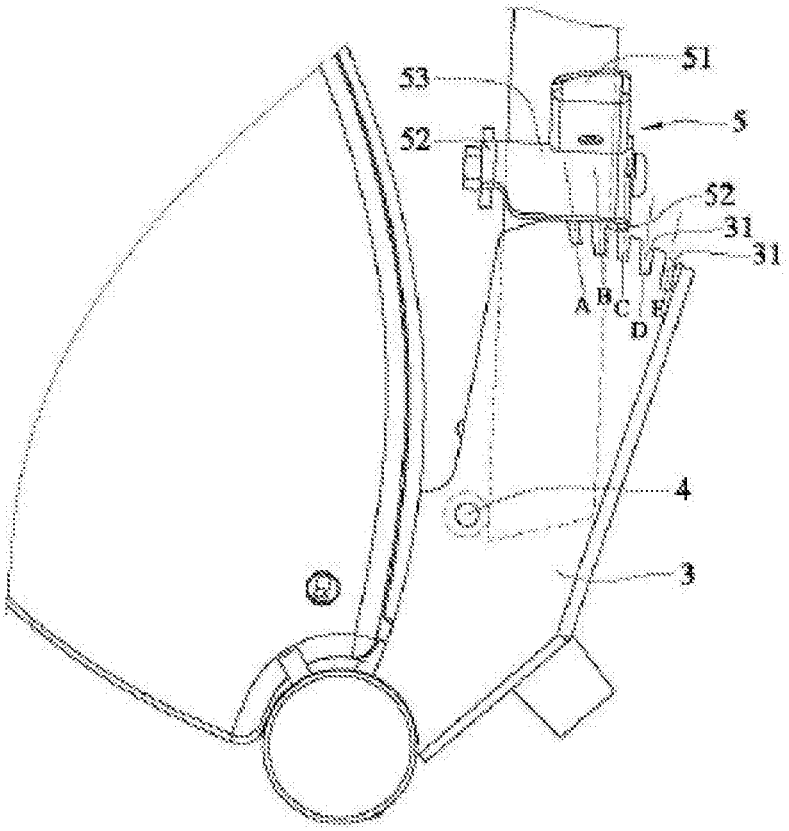
FIG. 6 is a structure schematic diagram of the bracket component in the unlocked state of the embodiment.
Figure 7:
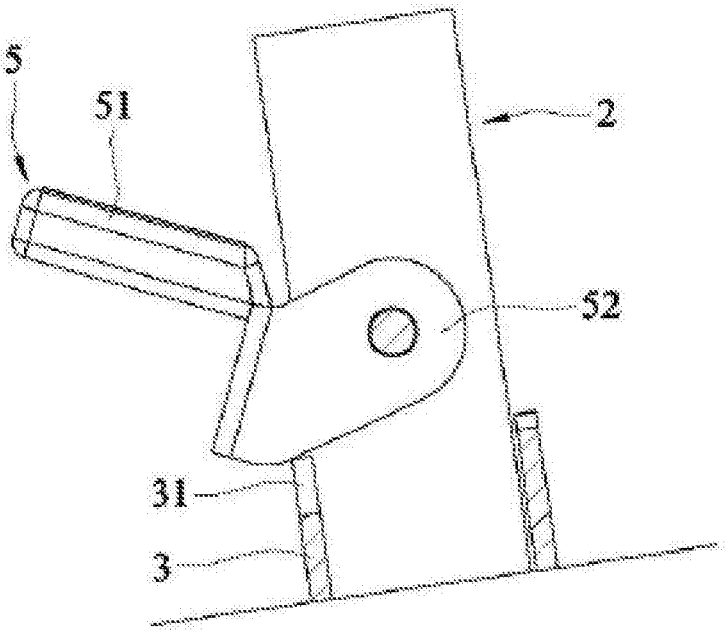
FIG. 7 is a side-view structure schematic diagram of the bracket component in the unlocked state of the embodiment.
Figure 8:
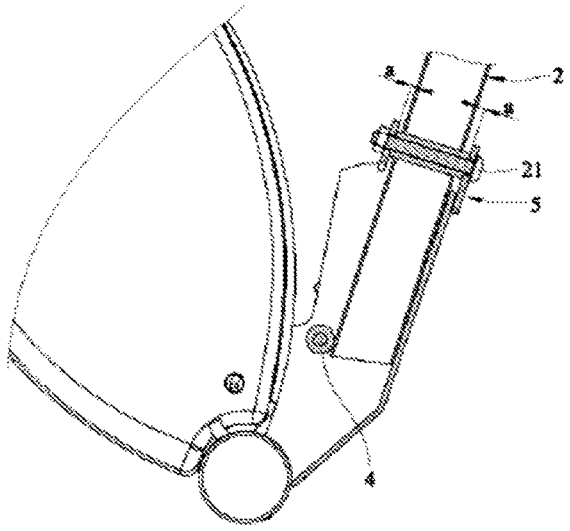
FIG. 8 is a longitudinal-section structure schematic diagram of the embodiment.
Figure 9:
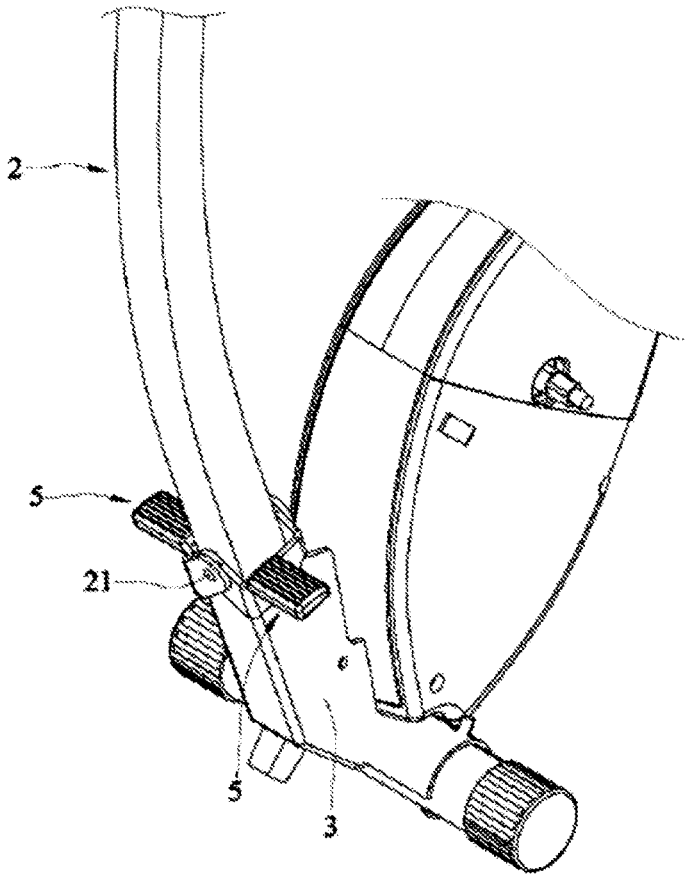
FIG. 9 is a structure schematic diagram of another embodiment of the utility model, and a left bracket component and a right bracket component are arranged in the embodiment.

In addition, besides the structure disclosed by the above embodiment, a left bracket component 5 and a right bracket component 5 can also be arranged in the utility model, specifically as shown in FIG. 8. The two bracket components 5 are arranged on the left side and the right side of the front upright 2 respectively and connected to the front upright 2 through the same central rotating point 21 (or through different rotating points), and positioning tooth grooves 31 corresponding to the bracket components 5 are arranged in the left side and the right side of the upper end of the U-shaped material respectively. According to the structure, the front upright 2 is positioned from the left side and the right side at the same time so that the front upright 2 can bear greater force in the front-back direction, and the stability and reliability of the structure are further improved. Since the structures and operating principles of the bracket components 5 and the positioning tooth grooves 31 of the structure are consistent with those in the first embodiment shown in FIG. 1, redundant details are not given.

Figure 12:
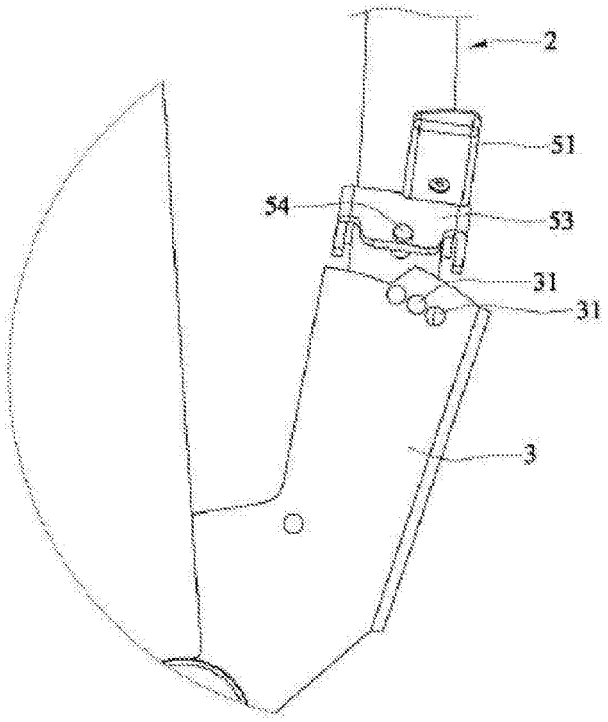
FIGS. 12-13 are structure schematic diagrams of another bracket part of the utility model.
Figure 13:
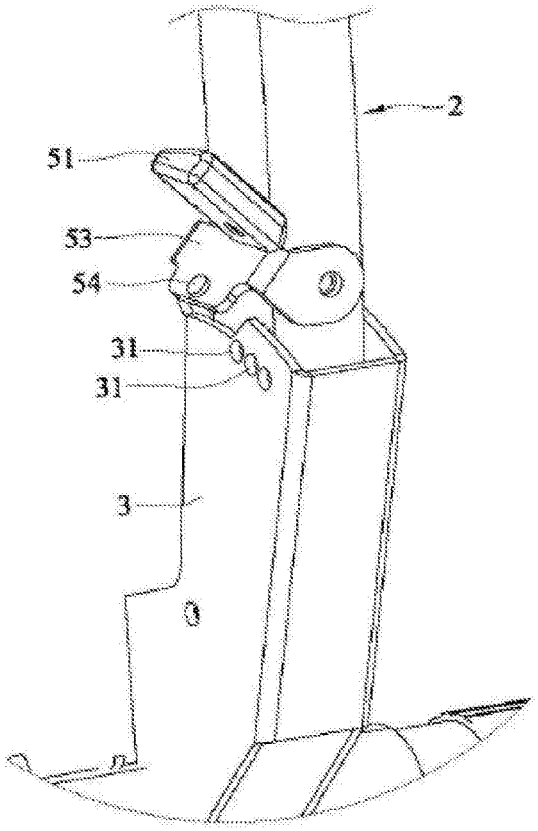
Figure 14:
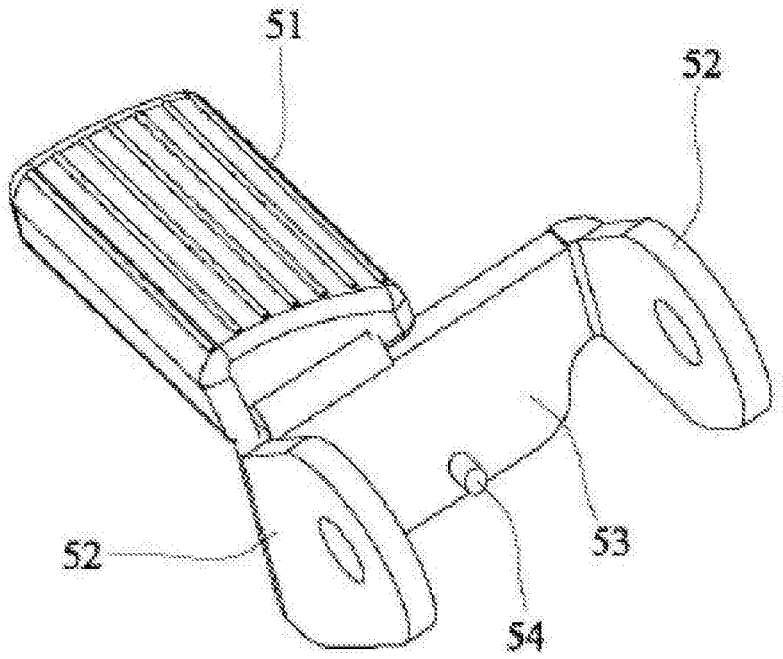
FIG. 14 is a structure schematic diagram of the bracket component and a positioning hole in FIG. 12.

In addition, the bracket components 5 and the bracket parts 31 of the utility model can also be of the structures shown in FIGS. 12-14. Specifically, the bracket parts are a plurality of positioning holes 31 which are formed in the supporting component in the swinging direction of the front upright, and corresponding positioning pins 54 are arranged on the middle pieces 53 of the bracket components 5. When the front upright 2 is adjusted to the required angle, the positioning pins 54 at the angle are aligned to the positioning holes 31, the bracket components are pressed downwards to insert the positioning pins 54 into the corresponding positioning holes, and thus the angle of the front upright 2 is fixed.

Figure 15:
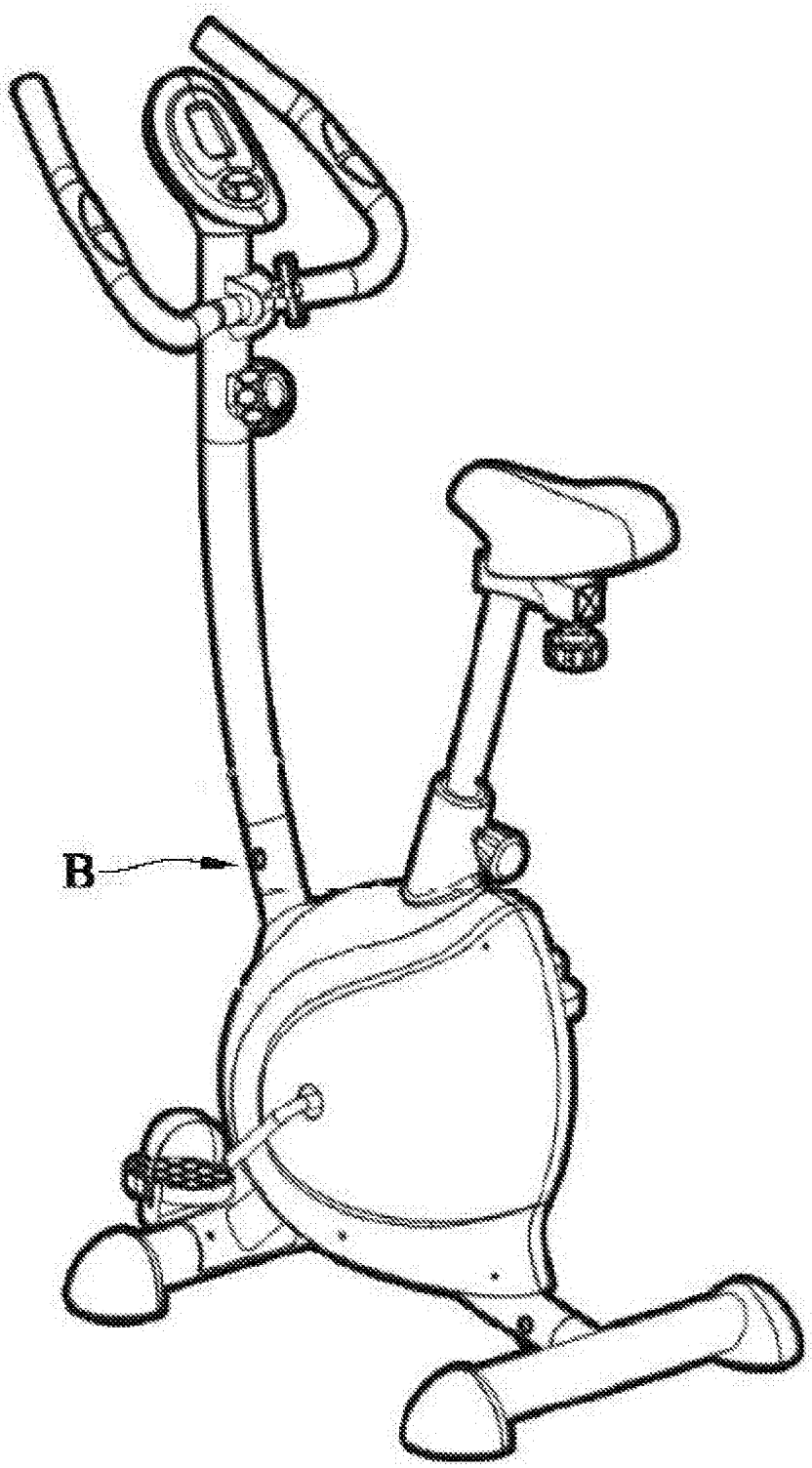
FIGS. 15-17 are structure schematic diagrams of the utility model applied to elliptical orbit machines of three outline structures.
Figure 16:
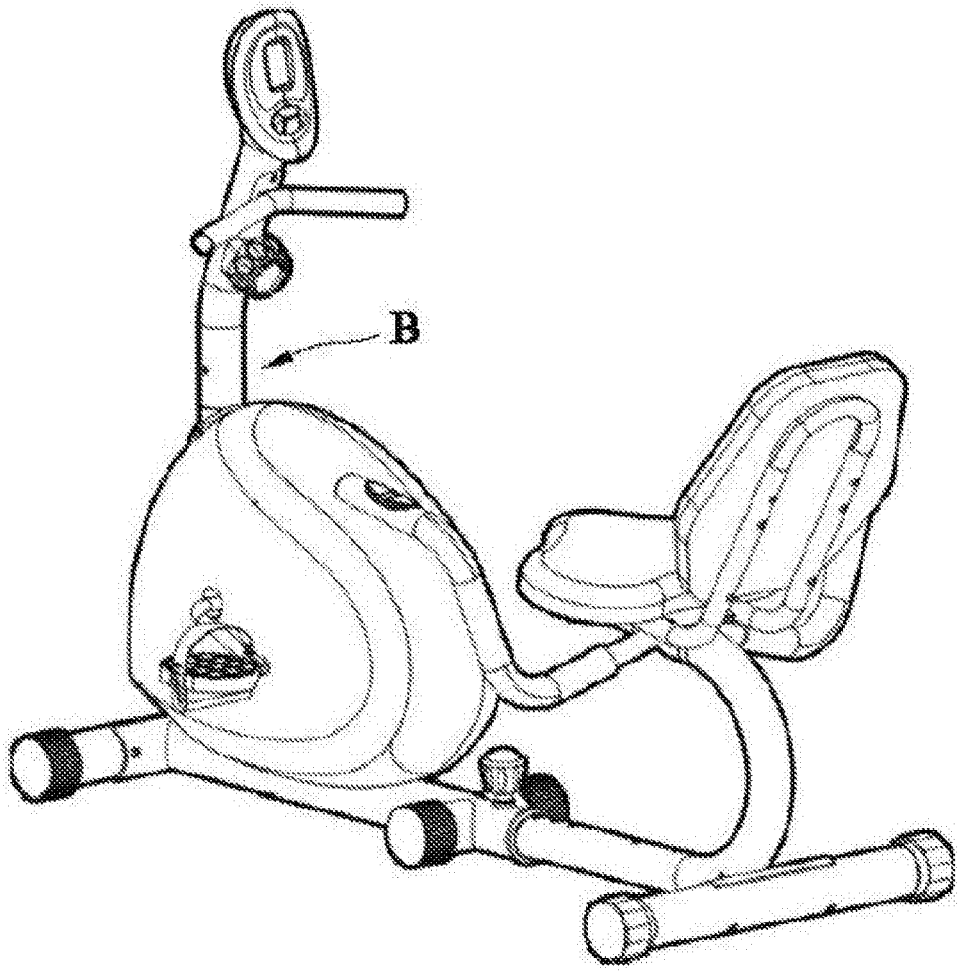
Figure 17:
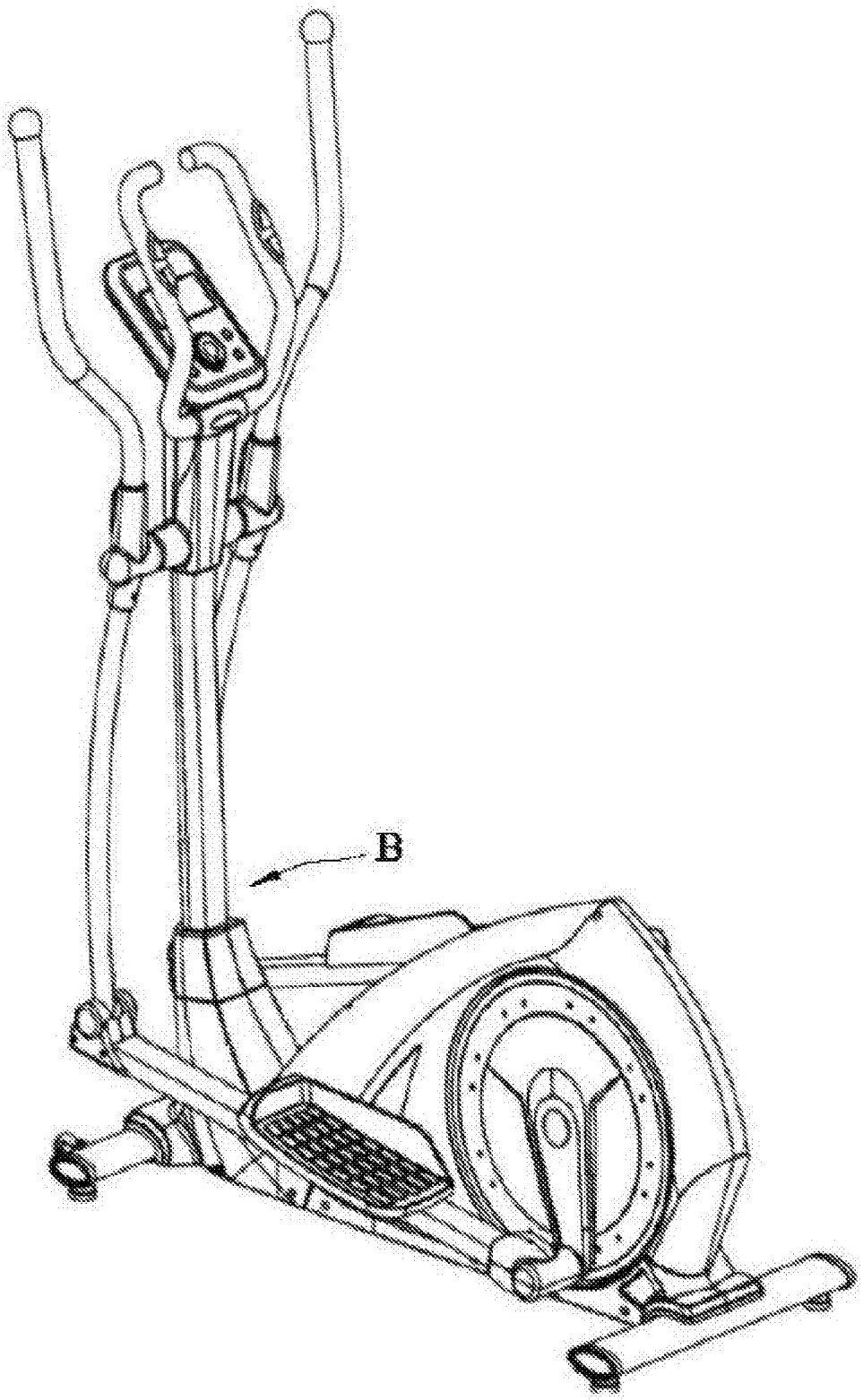

The adjustment bracket structure of the utility model can be applied to the exercise bicycle of the above structure and can also be applied to elliptic orbit machines of various outline structures shown in FIGS. 15-17, as shown by B. Since the structures and connecting relations of the adjustment bracket structure for the front upright applied to the equipment are consistent with the structure in the above embodiments, redundant details are not given.

The above embodiments are only specific implementations of the utility model and their descriptions are more specific and detailed, but do not limit the scope of the patent of the utility model. It should be pointed out that for those skilled in the field, various transformations and improvements can be made without deviating from the concept of the utility model, for example, the number of the positioning tooth grooves can be changed, and obvious substitutes are all within the protection scope of the utility model.

What is claimed is:

1. An adjustment bracket structure for a front upright of an exercise bicycle, comprising a bicycle frame and the front upright, wherein a supporting component which extends towards the front upright is fixed to the bicycle frame, the lower end of the front upright is pivoted to the supporting component through a rotary shaft, a bracket component capable of being clamped on the supporting component is arranged on the front upright, a plurality of bracket parts matched with the bracket component are arranged on the supporting component in the swinging direction of the front upright, the bracket parts are a plurality of positioning tooth grooves formed in the supporting component in the swinging direction of the front upright, the bracket component is a U-shaped component, two side pieces of the U-shaped component are positioned on the two sides of the front upright through rotating points respectively, the lower ends of the two side pieces or the lower end of one side piece are/is clamped in the positioning tooth grooves, and a handle is arranged on the outer side of a middle piece of the U-shaped component.

2. The adjustment bracket structure for the front upright of the exercise bicycle according to claim 1, wherein the bracket parts are a plurality of positioning holes formed in the supporting component in the swinging direction of the front upright, and positioning pins inserted into the positioning holes in the bracket parts are arranged on the bracket component.

3. The adjustment bracket structure for the front upright of the exercise bicycle according to claim 2, wherein the bracket component is a U-shaped component, the two side pieces of the U-shaped component are located on the two sides of the front upright through rotating points respectively, positioning pins are located on the middle piece of the U-shaped component, and a handle is arranged on the outer side of the middle piece of the U-shaped component.

4. The adjustment bracket structure for the front upright of the exercise bicycle according to claim 1, wherein gaps (a) are formed between the two side pieces and the side wall of the front upright, and the dimension of the gaps (a) is slightly greater than the material thickness of the supporting component.

5. The adjustment bracket structure for the front upright of the exercise bicycle according to claim 4, wherein the number of the bracket components is two, the two bracket components are arranged on the left side and the right side of the front upright respectively and connected to the front upright through the same central rotating point or through different rotating points, and bracket parts corresponding to the bracket components are arranged on the left side and the right side of the upper end of a U-shaped material.

6. The adjustment bracket structure for the front upright of the exercise bicycle according to claim 5, wherein the distances from the rotating points to the positioning tooth grooves are smaller than the distances from the rotating points to the handle.

7. The adjustment bracket structure for the front upright of the exercise bicycle according to claim 1, wherein the supporting component is a material with a U-shaped cross-section, and the lower section of the front upright is sleeved with the U-shaped material.

8. The adjustment bracket structure for the front upright of the exercise bicycle according to claim 3, wherein gaps (a) are formed between the two side pieces and the side wall of the front upright, and the dimension of the gaps (a) is slightly greater than the material thickness of the supporting component.

9. The adjustment bracket structure for the front upright of the exercise bicycle according to claim 8, wherein the number of the bracket components is two, the two bracket components are arranged on the left side and the right side of the front upright respectively and connected to the front upright through the same central rotating point or through different rotating points, and bracket parts corresponding to the bracket components are arranged on the left side and the right side of the upper end of a U-shaped material.

10. The adjustment bracket structure for the front upright of the exercise bicycle according to claim 9, wherein the distances from the rotating points to the positioning tooth grooves are smaller than the distances from the rotating points to the handle.

* * * * *